United States Patent [19]

Wittchow

[11] 4,205,633

[45] Jun. 3, 1980

[54] DEVICE FOR SEPARATING WATER AND STEAM IN A ONCE-THROUGH STEAM GENERATOR

[75] Inventor: Eberhard Wittchow, Erlangen, Fed. Rep. of Germany

[73] Assignee: Kraftwerk Union Aktiengesellschaft, Mülheim, Fed. Rep. of Germany

[21] Appl. No.: 931,021

[22] Filed: Aug. 4, 1978

[30] Foreign Application Priority Data

Aug. 5, 1977 [DE] Fed. Rep. of Germany ..... 2735463

[51] Int. Cl.[2] ..... F22B 37/62

[52] U.S. Cl. ..... 122/406 S; 122/451 S; 122/479 S

[58] Field of Search ..... 122/406 R, 406 S, 406 ST, 122/451 R, 451 S, 479 S

[56] References Cited

U.S. PATENT DOCUMENTS

| | | | |
|---|---|---|---|
| 2,294,501 | 9/1942 | Junkins | 122/406 |
| 3,021,824 | 2/1962 | Profos | 122/406 |
| 3,412,714 | 11/1968 | Michel | 122/406 |
| 3,464,393 | 9/1969 | Chambert | 122/406 |

FOREIGN PATENT DOCUMENTS

| | | | |
|---|---|---|---|
| 693330 | 6/1953 | United Kingdom | 122/406 |
| 768201 | 2/1957 | United Kingdom | 122/406 |

*Primary Examiner*—Edward G. Favors
*Attorney, Agent, or Firm*—Herbert L. Lerner

[57] ABSTRACT

System for separating water and steam in a continuous steam generator in which a separating device is interposed after the evaporator to separate steam from water coming from the evaporator. The steam goes to a second heating surface. Water is stored in the separating device and withdrawn through a discharge line for recirculating. A second discharge line above the first discharge line leads to the second heating surface. Control valve means control the discharge of water through the second discharge line. This system permits use of a highly heated second heating surface by effecting cooling of the heating surface during start-up and preventing damage to the heating surface material, and by providing the superheater surface for maintaining a high live steam temperature at partial load.

1 Claim, 1 Drawing Figure

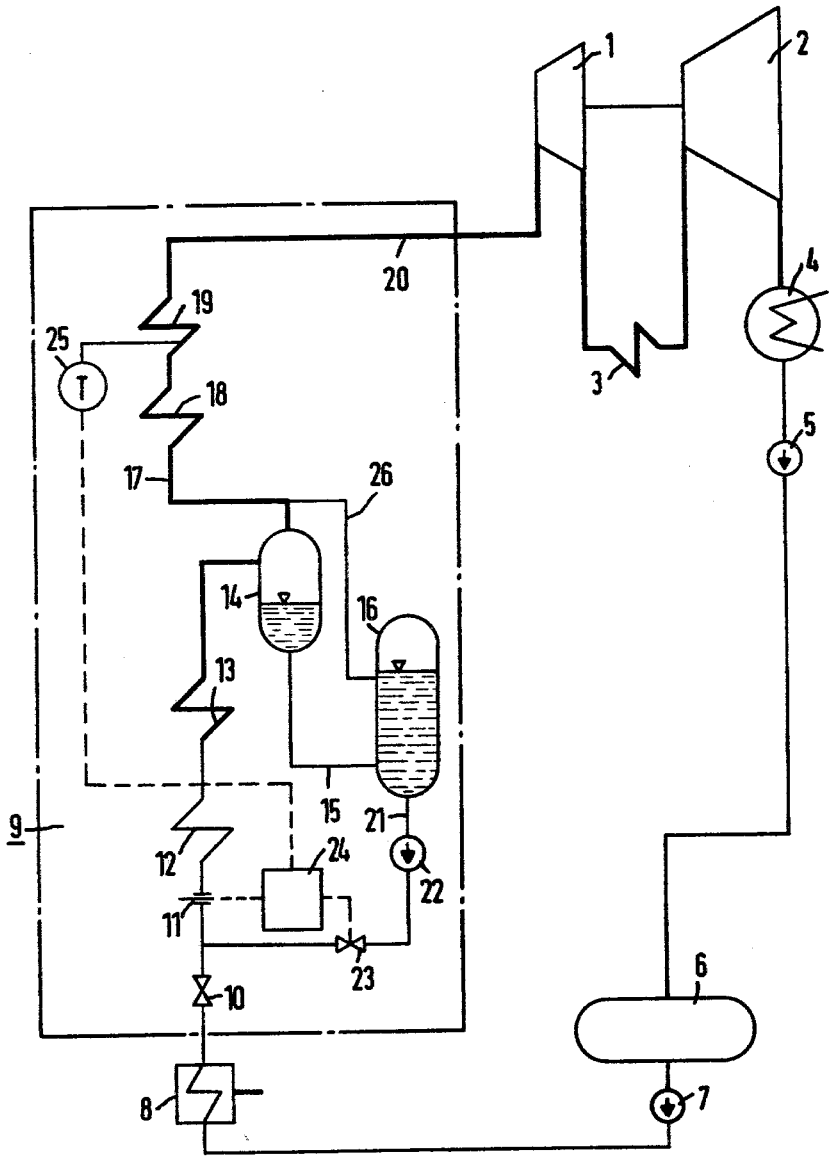
1
2
3
4
5
6
7
8
9
10
11
12
13
14
15
16
17
18
19
20
21
22
23
24
25
T
26

DEVICE FOR SEPARATING WATER AND STEAM IN A ONCE-THROUGH STEAM GENERATOR

BACKGROUND OF THE INVENTION

1. Field of the Invention

This invention relates to a continuous steam generator in which several evaporator and superheater heating surfaces are connected in series with a first evaporator heating surface followed by a separating device for separating water and steam.

2. Description of the Prior Art

In this separating device, water is separated primarily when the steam generator is started up as well as in partial-load operation. This water is stored in a tank which is either connected to the separating vessel via a connecting line or forms a structural unit with the latter. From this tank, the water is returned via a water discharge line to the inlet of the steam generator or is conducted to heat exchangers, to the feed water tank as well as to decompression devices. When the continuous steam generator is started up, the heating surfaces following the separating device are, in such an arrangement, cooled only slightly. This can lead to very high material temperatures and damage to the material if one of these heating surfaces is heated strongly. To avoid this, one could connect the separating device, not ahead of but only following this strongly highly heated heating surface. However, this would lead to an undesirable lowering of the live steam temperature in the case of partial load, because then the superheater surfaces connected between the separating device and the steam outlet are no longer sufficient for maintaining the desired live steam temperature at partial load.

SUMMARY OF THE INVENTION

It is therefore an object of the present invention to provide a system for separating water and steam in a continuous steam generator which will ensure that on the one hand, a strongly heated heating surface which follows the separating device, is sufficiently cooled during start-up, and on the other hand, the necessary superheater surface is available for maintaining a sufficiently high live steam temperature at partial load. With the foregoing and other objects in view, there is provided in accordance with the invention a system for separating water and steam in a continuous steam generator including (a) an evaporator heating surface for evaporating water to steam, (b) a separating device connected to the evaporator to receive steam and water from the evaporator; the water collecting into a lower liquid layer in the separating device and the steam in an upper layer above the lower liquid layer of water, (c) a steam discharge line connected to the separating device for the discharge of steam from the upper layer, (d) a second heating surface connected to the steam discharge line for heating the steam from the separating device, (e) a water discharge line connected to the separating device for the discharge of water from the lower liquid layer of water in the separating device, (f) a second water discharge line connected to the separating device at a point above the discharge point of the first water discharge line for the discharge of water from the separating device to the second heating surface, and (g) control valve means for controlling the discharge of water through the second water discharge line. Other features which are considered as characteristic for the invention are set forth in the appended claims. Although the invention is illustrated and described herein as embodied in a device for separating water and steam in a once-through steam generator, it is nevertheless not intended to be limited to the details shown, since various modifications may be made therein without departing from the spirit of the invention and within the scope and range of equivalents of the claims.

BRIEF DESCRIPTION OF THE DRAWING

The invention, however, together with additional objects and advantages thereof will be best understood from the following description when read in connection with the accompanying drawing, in which is diagrammatically illustrated a steam power generating plant having a continuous steam generator for supplying steam-turbines.

DETAILED DESCRIPTION OF THE INVENTION

The invention relates to an arrangement for separating water and steam in a continuous steam generator comprising a separating device for separating water and steam, the separating device following an evaporator heating surface. The steam outlet line of the separating device is connected to a heating surface following thereon. The separating device has a tank for storing water, to which a water discharge line is connected. In accordance with the invention, a second water discharge line which leads to an evaporator heating surface following the separating device starts from the tank for storing water above the point where the first water discharge line is connected. A control valve is provided which influences the water discharge from the tank for storing water through the second water discharge line. An embodiment example is shown in the drawing with reference to a steam power generating plant comprising a continuous steam generator for supplying steam turbines. The steam expanded in a high-pressure turbine 1 and a low-pressure turbine 2 with a reheater 3 is condensed in a condenser 4. The condensate is sent via a pump 5 to a feed water tank 6 and is forced from there by a feed water pump 7 through steam-heated high-pressure preheaters 8 to the continuous steam generator designated generally by the numeral 9. There, the water flows through a feed water valve 10, a flow measuring orifice 11, an economizer heating surface 12 and a first evaporator heating surface 13 into a separating vessel 14 for separating water and steam. In the embodiment example, the separating vessel 14 is connected by a connecting line 15 to a tank 16 for storing water. These tanks connected to each other therefore constitute a separating device with a storing facility for the separated water. However, it is not absolutely necessary to provide a separate tank for the water storage. The separation of water and steam and the storage of the water can also be performed in a common tank.

A steam discharge line 17 from the separating vessel 14, leads to a second evaporator heating surface 18, which in turn is followed by one or several superheater heating surfaces 19. A live steam line 20 connected to the exit of the superheater heating surface 19, leads to the high-pressure turbine 1. Check valves, bypass lines and the like in the steam line leaving the steam generator are not shown for the sake of simplification. In the embodiment example, a water discharge line 21 leads from the tank for storing water 16 to a circulating pump 22 and from there, via a control valve 23, to the entrance of the economizer heating surface 12. The control valve is connected to a control unit 24 which is connected via measuring lines to the flow measuring orifice 11 and a temperature measuring device 25. Above the water discharge line 21, a second water discharge line 26, which opens into the entrance of the second evaporator heating surface 18, is connected to the tank 16. The control unit 24 regulates the water level in the tank 16 as a function of the temperature in the, for instance, heavily heated second evaporator surface 18 in such a manner that it rises, if the temperature of the second evaporator surface 18 is too high, until water gets into the second evaporator heating surface 18 through the water discharge line 26 and therby contributes to the cooling. This water level control could also be set in dependence on the operating condition of the continuous steam generator instead of by the temperature measuring device 25. In that case, a high water level would always be provided in the tank 16 during the starting-up process. The water level must of course be disposed above the entrance of the second evaporator to obtain flow of water through line 26. The admixing of water to the steam flowing into the second evaporator heating surface 18 can, of course, also be regulated by inserting, for instance, a control valve into the water discharge line 26.

There is claimed:

1. System for separating water and steam between an evaporator heating surface and a second heating surface in a continuous steam generator with a separating vessel connected to the evaporator to receive and separate steam and water therefrom, a steam discharge line of the separator connected to the entrance of the second heating surface, a first water discharge line of the separator for the discharge of separated water into a connected tank for receiving the separated water, a second water discharge line connected to the tank for the discharge of water in the tank, a pump and a control valve for regulating the flow of water from the tank through the second water discharge line, the improvement comprising a third water discharge line connected to the tank at a point above the second water discharge line and near the water level of the water in the tank, said water level disposed at an elevation above the entrance of the second heating surface for flow of water from said tank to said entrance, said third water discharge connected to the steam discharge line to discharge water from the tank into the steam discharge line and thence to the entrance of the second heating surface, a temperature device for determining the temperature of the second heating surface, control means connected to the temperature device and the control valve to regulate the water level in the tank as a function of the temperature with the water level rising above the connecting point of the third water discharge line to the tank when the temperature rises too high at the second heating surface and with the discharge of water from the tank to the steam discharge line and entrance of the second heating surface to cool the latter, and conversely when the temperature drops, the water level drops, and the flow of water through the third discharge line abates.

* * * * *